United States Patent [19]

Beaumont

[11] Patent Number: 4,858,916

[45] Date of Patent: Aug. 22, 1989

[54] WEIGHTED EXERCISE APPARATUS

[76] Inventor: Jeff Beaumont, 1411 Niles Cortland Rd., Cortland, Ohio 44410

[21] Appl. No.: 189,793

[22] Filed: May 3, 1988

[51] Int. Cl.[4] ..... A63B 21/12

[52] U.S. Cl. ..... 272/119; 272/117

[58] Field of Search ..... 272/67, 68, 93, 116, 272/119, 122, 123, 124, 143, 117

[56] References Cited

U.S. PATENT DOCUMENTS

| | | | |
|---|---|---|---|
| 4,109,908 | 8/1978 | Pugh et al. | 272/119 |
| 4,330,120 | 5/1982 | Netti | 272/67 X |
| 4,484,740 | 11/1984 | Green | 272/122 X |
| 4,585,228 | 4/1986 | Olson | 272/143 X |
| 4,610,448 | 9/1986 | Hill | 272/143 X |
| 4,684,122 | 8/1987 | Desmond et al. | 272/119 |

FOREIGN PATENT DOCUMENTS

| | | | |
|---|---|---|---|
| 111378 | 8/1925 | Switzerland | 272/119 |

*Primary Examiner*—Richard J. Apley
*Assistant Examiner*—Robert W. Bahr
*Attorney, Agent, or Firm*—Leon Gilden

[57] ABSTRACT

A weighted exercise apparatus is set forth wherein a platform is positioned underlying a user's wrist with a rearwardly oriented securable strap including hook and loop fasteners is cooperative with a transverse gripping bar securable by one of said user's hands. Underlying said platform are a series of coaxially aligned and adjustable weights positionable about a downwardly extending boss member secured orthogonally to said platform and medially of said gripping bar for alignment of said weights to a user's hand.

7 Claims, 5 Drawing Sheets

WEIGHTED EXERCISE APPARATUS

BACKGROUND OF THE INVENTION

1. Field of the Invention

The field of invention relates to exercise equipment and more particularly pertains to a new and improved arm exercising apparatus that may be readily and easily secured about a user's forearm and provided with adjustable plates symmetrically oriented to an overlying gripping bar and an associated user's hand.

2. Description of the Prior Art

The use of exercising apparatus is well known in the prior art. As may be appreciated, these devices have normally been of elaborate construction or have been of complex and cumbersome organization that have enjoyed limited acceptance and application by individuals. In this connection, there have been several attempts to develop exercising apparatus which may be easily and efficiently utilized when desired. For example, U.S. Pat. No. 3,759,510 to Jackson, Jr. sets forth a complete exercising body garment that is worn by a user that completely encompasses a user from a user's feet to head wherein various pockets are positioned about the garment for positioning of weights for exercising various muscles of a user. The Jackson patent is of a relatively complex and cumbersome structure, as is typical of the prior art, and an organization remote to that of the instant invention, but of interest relative to the teaching of an exercising apparatus.

U.S. Pat. No. 4,039,183 to Sakurada sets forth a wrist exercising apparatus wherein a wrist securable band has positioned thereto a spring biased handle by which a user may strengthen a desired wrist by pivoting the handle relative to the band against the force of the associated springs. The apparatus to Sakurada is of interest relative to a wrist secured exercising device, but is of a relatively limited applicability as to that of the instant invention.

U.S. Pat. No. 4,247,097 to Schwartz teaches the use of an exercising weighted glove that totally encompasses a user's wrist and hand and included with packets for securement of weights for the purpose of exercise of the individual's arm and associated body part. The Schwartz patent is of a relatively cumbersome organization and furthermore is resistant to use by individuals due to the enclosed organization and associated heat generated by enclosing a body part during an exercise procedure.

U.S. Pat. No. 4,330,120 to Netti sets forth another enclosing exercising device that is securable about a user's hand, wrist, and forearm wherein variously oriented pockets are secured about the device for insertion of various weights that is consistent with a normal swing motion, as in running or jogging. The Netti patent, while of interest relative to a weighted glove organization, fails to provide the means for exercising a user's wrist, forearm, and associated shoulder and body parts by means of a properly aligned and oriented adjustable weight organization, as of the instant invention.

U.S. Pat. No. 4,337,937 to Lopez sets forth an adjustable wrist exercising device wherein torsional gripping sleeves are adjustable to vary resistance to the gripping sleeves and thereby vary the effort required by a user in twisting the sleeves relative to a central bar. The Lopez patent is of interest merely to note the prior art in setting forth wrist and hand exercising apparatus.

U.S. Pat. No. 4,368,883 to Tiktin sets forth a glove provided with a dangling flaccid chain organization whereby various weights may secured, but the glove as opposed to the instant invention will vary the orientation of a suspended weight relative to the glove for securement organization and thereby limit the concentration of exercising effort at a pre-desired orientation relative to a user.

As such, it may be appreciated that there is a continuing need for a new and improved weighted exercising apparatus which addresses both the problem of ease of use, adjustability, and predetermined and aligned orientation of weighted means relative to a user's body part to focus exercise concentration at that part wherein this respect, the present invention substantially fulfills this need.

SUMMARY OF THE INVENTION

In view of the foregoing disadvantages inherent in the known types of exercising apparatus now present in the prior art, the present invention provides an weighted exercise apparatus wherein the same is readily securable to a user and may be further easily and efficiently adjusted by means of axially aligned and oriented weights relative to a user's hand and an associated securable grasping bar. As such, the general purpose of the present invention, which will be described subsequently in greater detail, is to provide a new and improved weighted exercise apparatus which has all the advantages of the prior art exercise apparatus and none of the disadvantages.

To attain this, the present invention comprises an exercise apparatus which may be readily securable to a user's hand by means of associated hook and loop strapping and a grasp bar formed to an underlying platform wherein an associated orthogonally oriented boss and an orthogonal and medially aligned relationship to said grasp bar has selectively securable thereto a plurality of nestable weights positionable within one another for compactness and orientation of a center of gravity of the noted weights in close proximity to said grasp bar and ultimately a user's hand.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved weighted exercise apparatus which has all the advantages of the prior art weighted exercise apparatus and none of the disadvantages.

It is another object of the present invention to provide a new and improved weighted exercise apparatus which may be easily and efficiently manufactured and marketed.

It is a further object of the present invention to provide a new and improved weighted exercise apparatus which is of a durable and reliable construction.

An even further object of the present invention is to provide a new and improved weighted exercise apparatus which is susceptible of a low cost of manufacture with regard to both materials and labor, and which accordingly is then susceptible of low prices of sale to the consuming public, thereby making such weighted exercise apparatus economically available to the buying public.

Still yet another object of the present invention is to provide a new and improved weighted exercise apparatus which provides in the apparatuses and methods of the prior art some of the advantages thereof, while simultaneously overcoming some of the disadvantages normally associated therewith.

Still another object of the present invention is to provide a new and improved weighted exercise apparatus wherein a readily securable platform is positionable relative to a user's wrist and hand and has provided with a grasp bar on one side thereof with a plurality aligned weights relative to said grasp bar to maintain a desired center of gravity proximate said grasp bar for concentrating of effort during exercise procedure by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
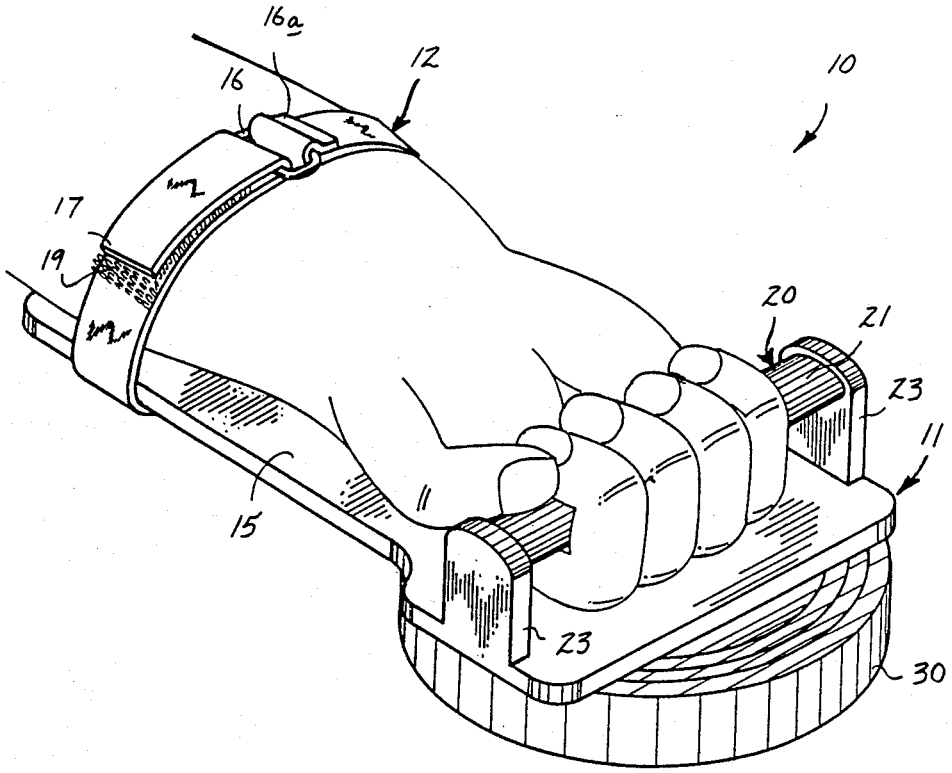
FIG. 1 is an isometric illustration of the instant invention.

With reference now to the drawings, and in particular to FIGS. 1 to 16 thereof, a new and improved weighted exercise apparatus embodying the principles and concepts of the present invention and generally designated by the reference numeral 10 will be described.

More specifically, it will be noted that the weighted exercise apparatus 10 essentially comprises a platform 11 associated with a forearm strap 12, a grasp bar 20, and an aligned underlying series of weights to said grasp bar.

Figure 2:
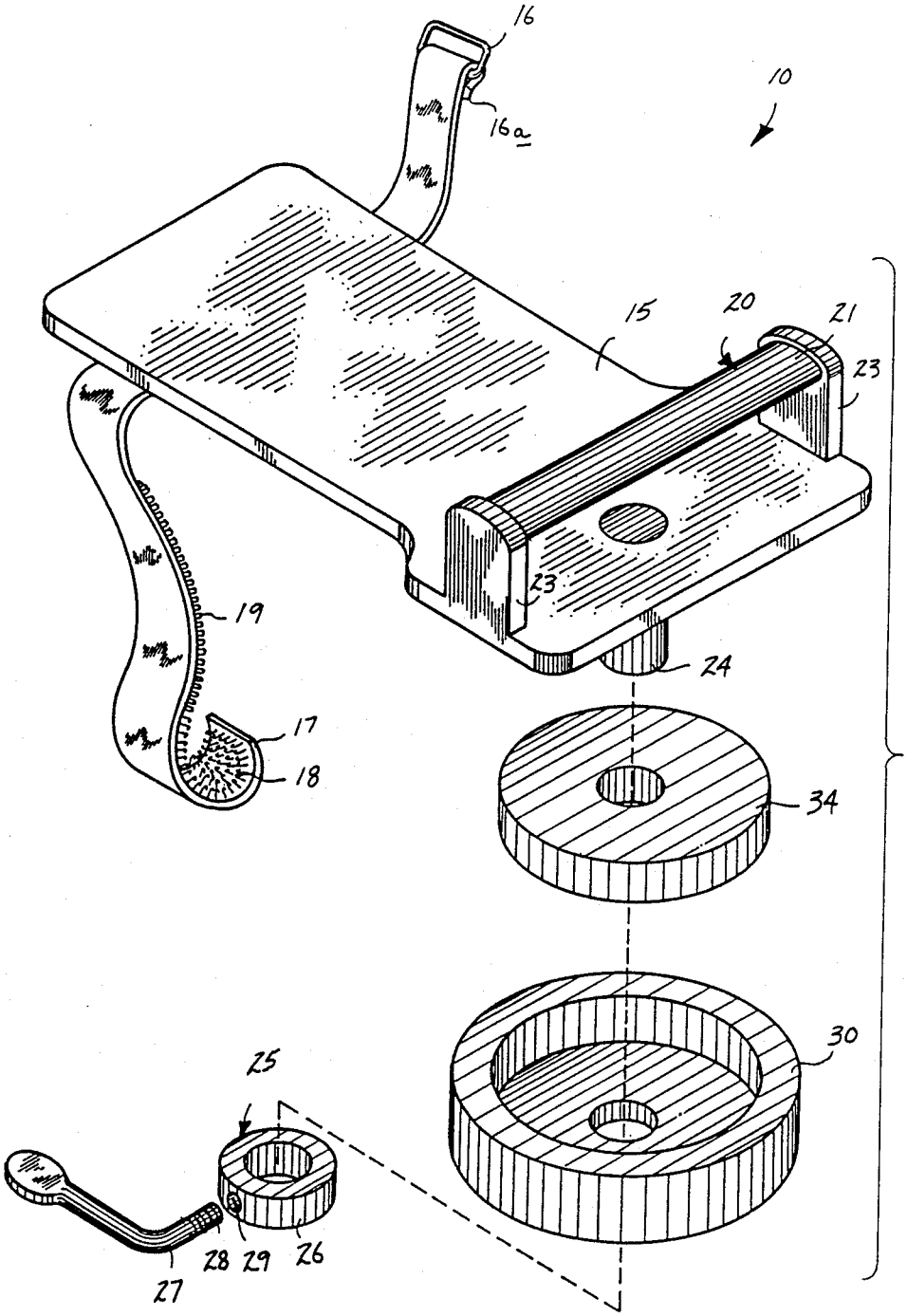
FIG. 2 is an isometric exploded view of the invention as set forth in FIG. 1.
Figure 3:
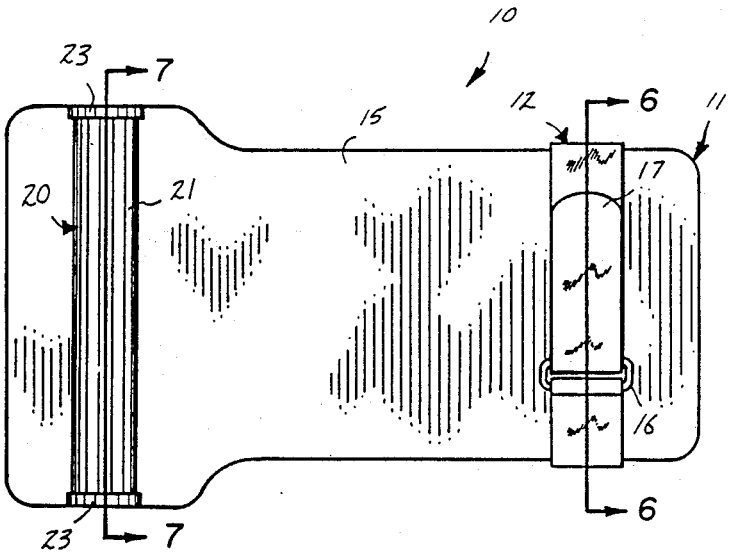
FIG. 3 is a top orthographic view of the instant invention.
Figure 4:
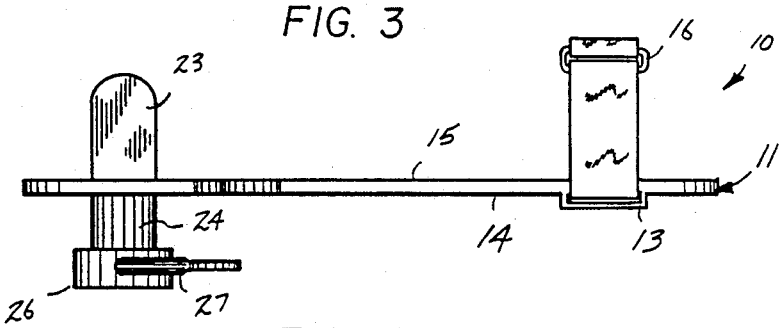
FIG. 4 is an orthographic view taken in elevation of the instant invention.
Figure 5:
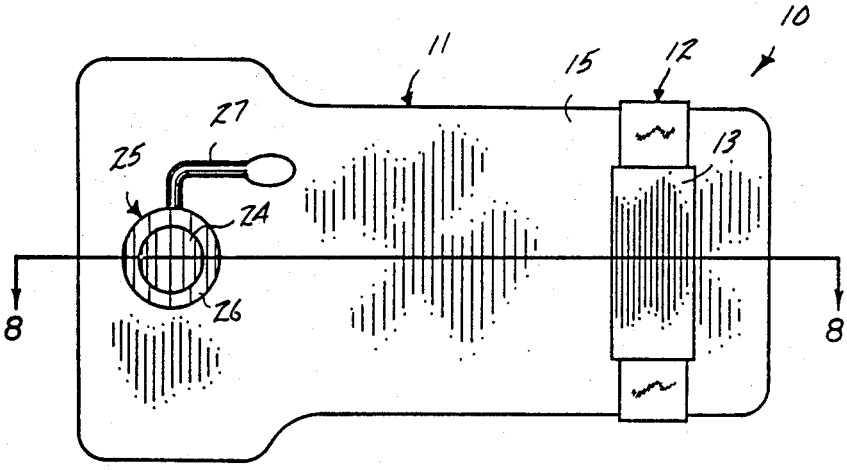
FIG. 5 is a bottom orthographic view of the instant invention.
Figure 6:
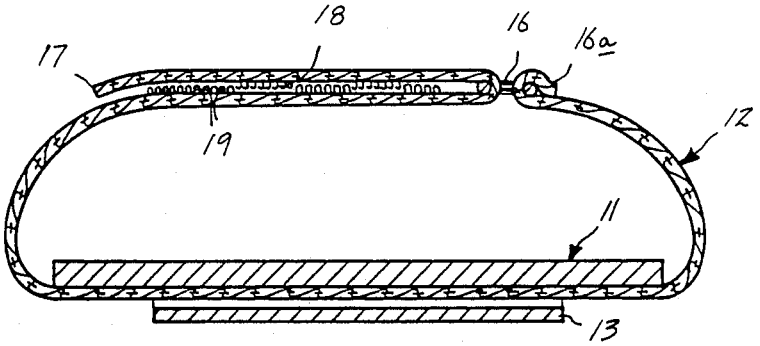
FIG. 6 is an orthographic view taken along the lines 6—6 of FIG. 3, in the direction indicated by the arrows.

As illustrated in FIG. 2, the platform 11 is formed with an upper surface 15 and a lower surface 14, as illustrated in FIG. 4 for example, wherein forearm strap 12 is captured within a rectangular sleeve 13 integrally secured to lower surface 14. The strap 12 is provided with a first end **16*a* that may be adhesively secured to strap 13 or sewn thereover to thereby form a loop and secure a strap loop therein. The strap loop cooperates with second end 17 that has formed proximate thereto a hook and loop securement organization formed with hooks 18 about a surface adjacent second end 17 with a series of securement loops formed about a surface adjacent the hook surface 18. Accordingly, as illustrated in FIG. 1, the second end 17 may be passed through the strap loop 16 and thereupon the hooks 18 secured to loops 19** and thereby securely maintained in a selectively releasable manner the apparatus to a user's forearm.

Figure 7:
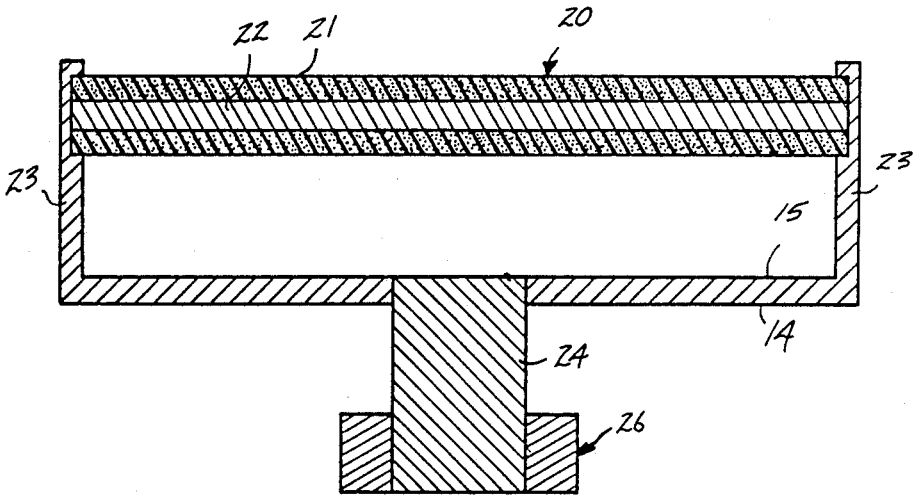
FIG. 7 is an orthographic view taken along the lines 7—7 of FIG. 3, in the direction indicated by the arrows.
Figure 8:
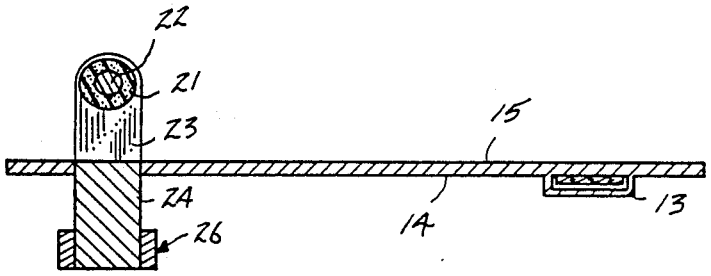
FIG. 8 is an orthographic view taken along the lines 8—8 of FIG. 5, in the direction indicated by arrows.

As the forearm strap organization 12 is secured proximate a rear terminal end of the platform 11, a grasp bar 20 is secured proximate a forward terminal end of the platform 11, as illustrated. Reference to FIG. 8 illustrates the grasp bar 20 has formed with a resilient rubber-like covering 21 for the extended use of the apparatus due to the repetitive type nature of an exercising procedure wherein the covering 21 is formed about a rigid core 22 that is preferably formed of a metallic material, but may be in fact formed of any suitable material such as plastics and the like. The grasp bar 20 extends generally transversely of platform 11 and parallel to the sleeve 13 and associated strap 12. A plurality of vertical support stanchions are integrally formed to terminal forward sides of the platform 11 to position the grasp bar 20 at an elevated distance above the upper surface 15. It should also be noted that the forward surface of platform 11 where grasp bar 20 is secured is of a generally wider configuration, as opposed to the rearward portion of the platform 11 upon which the forearm rests due to the need to accommodate a user's hand and thereby the width of the surface underlying grasp bar 20 is accordingly wider. Illustrated in FIGS. 2, 4, 5, 7, and 8 is a boss 24 orthogonally and integrally formed to the platform 11 and aligned with grasp bar 20 and positioned medially of grasp bar 20's length, as best illustrated in FIG. 7. This orientation of the boss 24 is significant to properly orient and align the center of gravity of weights positioned about the boss 24.

Figure 13:
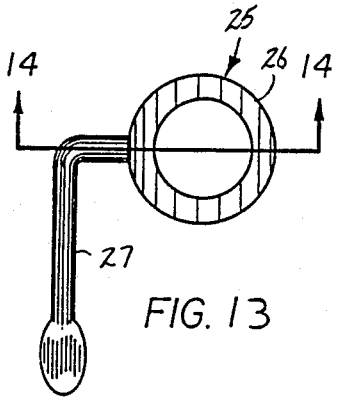
FIG. 13 is a top orthographic view of the clamp as utilized by the instant invention.
Figure 15:
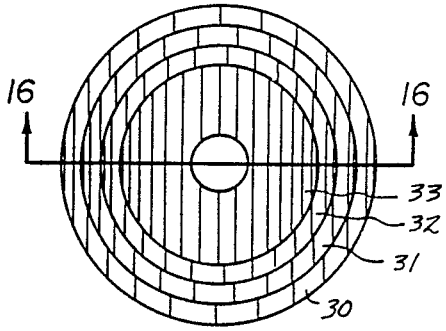
FIG. 15 is a top orthographic view of a further example of nestable weights as utilized by the instant invention.
Figure 14:
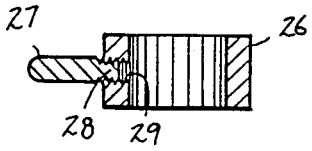
FIG. 14 is an orthographic view taken along the lines 14—14 of FIG. 13.

A clamp 25, as illustrated in FIGS. 2, 13, and 14, is formed with a ring 26 and an associated lock handle 27 formed with a threaded end 28 on a distal end of lock handle 27 to cooperate with a threaded radial bore 29 within ring 26 to secure an association of weights between surface 15 and the clamp 25 about boss 24.

Figure 9:
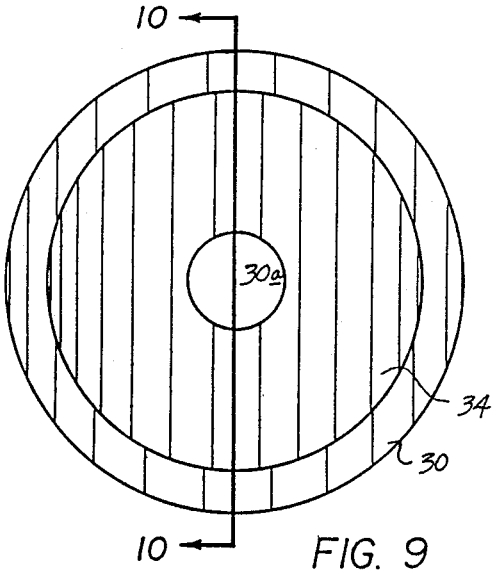
FIG. 9 is a top orthographic view of a cup-shaped securement weight as utilized by the instant invention.
Figure 11:
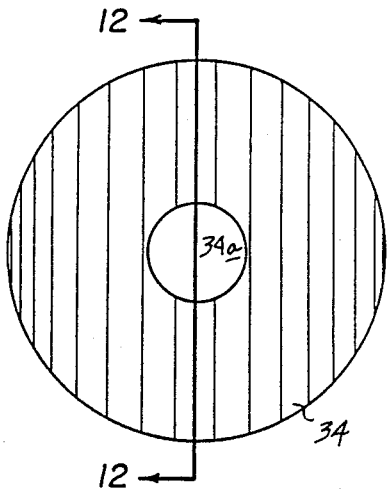
FIG. 11 is a top orthographic view of an insert as utilized with the cup-shaped weight of FIG. 9.
Figure 10:
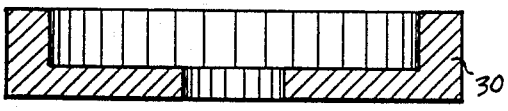
FIG. 10 is an orthographic view taken along the lines 10—10 of FIG. 9.
Figure 12:
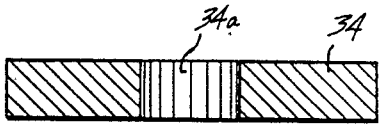
FIG. 12 is an orthographic view taken along the lines 12—12 of FIG. 11.
Figure 16:
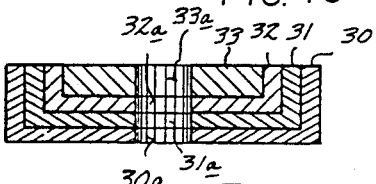
FIG. 16 is an orthographic view taken along the lines 16—16 of FIG. 15 in the direction indicated by the arrows.

As illustrated in FIGS. 1, 2, 9, 10, 11, 12, 15, and 16 are the associated weights, as utilized with the instant invention. Essentially, an outer cup-shaped weight 30 is formed with an interior and an axially formed opening to slidingly cooperate with boss 24. Either an individual weight 34, as illustrated in FIG. 11, is utilized and positioned within the interior of the cup-shaped weight 30, as illustrated in FIG. 9, or alternatively a series of weights, such as first weight 31, second weight 32, and third weight 33, are positionable within the interior of cup-shaped weight 30 to provide a greater latitude of adjustment of the amount of weight utilized by an individual. As illustrated in FIG. 16, the series of weights 31 through 33 are completely nestable within the cup-shaped weight 30 and are formed with progressively decreasing heights to position themselves within the interior of the cup-shaped weight 30 and not protrude therefrom. Accordingly, a series of cup-shaped weights 30 through 32 are utilized with a final interior weight 33 of generally cylindrical configuration to fill the remaining void within the second cup-shaped weight 32. It may be understand that an even greater number of cup-shaped weights may be utilized dependent upon the needs of an individual and the series of four weights, as illustrated in FIG. 16 for example, are merely illustrative.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A weight exercise apparatus for securement to a forearm and graspable by a hand of an individual comprising, a platform means including an upper surface and a lower surface, and a strap means extending with first and second terminal ends for overlying said upper surface for selective securement to said forearm wherein said strap means is captured in a sleeve integrally secured to said lower surface adjacent a rear end of said platform means, and a grasp bar means integrally secured to said upper surface proximate a forward end of said platform means and extending parallel to said sleeve, and a weight means for providing weighted resistance to said apparatus, and a weight support means aligned with said grasp bar means for selective securement of a weight means thereto in an aligned relationship to said grasp bar means, and wherein said weight means comprises a cylindrical boss integrally and orthogonally formed and extending outwardly of said lower surface orthogonal to said lower surface and said grasp bar means wherein said weight support means is further medially positioned relative to said grasp bar means.

2. A weight exercise apparatus as set forth in claim 1 wherein said weight support means further includes a clamp for capturing said weight means between said clamp and said lower surface.

3. A weight exercise apparatus as set forth in claim 2 wherein said clamp comprises a cylindrical ring slidably positionable over terminal end of said weight support means formed with a threaded radial bore for accepting a threaded rod to secure said clamp to said weight support means.

4. A weight exercise apparatus as set forth in claim 3 wherein said weight means further comprises an exteriorly positioned cup-shaped weight slidably securable to said weight support means through an axial bore within said cylindrical cup-shaped weight means.

5. A weight exercise apparatus as set forth in claim 4 wherein said cup-shaped weight nestably accepts at least one further cup-shaped weight completely within an interior surface of said cup-shaped weight.

6. A weight exercise apparatus as set forth in claim 5 wherein said grasp bar means comprises a central rigid bar rigidly secured to a plurality of upright stanchions, said upright stanchions integrally and orthogonally oriented to said upper surface at first ends and securing said rigid bar therebetween at second ends spaced above said upper surface to orient said grasp bar parallel to said upper surface wherein said grasp bar means further includes a resilient padding about said bar for grasping by said hand of an individual.

7. A weight exercise apparatus as set forth in claim 6 wherein said strap means includes a first terminal end having a ring secured thereto and a second terminal formed with a series of hook fasteners associable with a series of loop fasteners positioned adjacent said hook fasteners for securement of said second end through said ring and enabling securement of said hook fasteners to said loop fasteners.

* * * * *